US011879662B2

(12) United States Patent
Carroll

(10) Patent No.: US 11,879,662 B2
(45) Date of Patent: Jan. 23, 2024

(54) DROP IN FLUSH MOUNT REGISTER

(71) Applicant: DECOR GRATES INCORPORATED, Ajax (CA)

(72) Inventor: Owen Carroll, Ajax (CA)

(73) Assignee: DECOR GRATES INCORPORATED, Ajax, CA (US)

( * ) Notice: Subject to any disclaimer, the term of this patent is extended or adjusted under 35 U.S.C. 154(b) by 296 days.

(21) Appl. No.: 17/127,602

(22) Filed: Dec. 18, 2020

(65) Prior Publication Data

US 2021/0108824 A1 Apr. 15, 2021

Related U.S. Application Data

(63) Continuation-in-part of application No. 16/290,499, filed on Mar. 1, 2019, now Pat. No. 11,460,216.

(60) Provisional application No. 62/637,694, filed on Mar. 2, 2018.

(51) Int. Cl.
*F24F 13/00* (2006.01)
*F24F 13/08* (2006.01)
*F24F 13/15* (2006.01)

(52) U.S. Cl.
CPC ..... *F24F 13/084* (2013.01); *F24F 13/15* (2013.01)

(58) Field of Classification Search
CPC ..... F24F 13/1426; F24F 13/1413; F24F 2013/1473; F24F 13/068; F24F 13/082
USPC ..... 454/290, 330–332
See application file for complete search history.

(56) References Cited

U.S. PATENT DOCUMENTS 770,326 A * 9/1904 Slater ..... F24F 13/06 454/290
4,625,632 A * 12/1986 Markman ..... F24F 13/1486 29/890.12
5,058,490 A * 10/1991 Sodec ..... F24F 13/06 454/289
5,551,915 A * 9/1996 Schweikert ..... F24F 13/06 454/308
5,984,776 A * 11/1999 Berger ..... F24F 13/085 55/491
6,234,894 B1 * 5/2001 Goracke ..... F24F 13/082 454/324
6,503,140 B1 * 1/2003 Haynes ..... F24F 13/1413 454/325
8,882,572 B2 * 11/2014 McReynolds ..... G05D 23/27 137/343
9,028,309 B2 * 5/2015 Rimmer ..... F24F 13/084 454/289
10,704,800 B2 * 7/2020 Pridemore ..... F24F 11/30
2003/0139133 A1 * 7/2003 Hardy ..... F24F 7/10 454/290
2003/0220068 A1 * 11/2003 Orendorff ..... F24F 13/12 454/290
2003/0220069 A1 * 11/2003 Orendorff ..... F24F 13/082 454/290

(Continued)

FOREIGN PATENT DOCUMENTS

WO WO-2017214697 A1 * 12/2017 ..... F24F 13/06

*Primary Examiner* — Ko-Wei Lin
(74) *Attorney, Agent, or Firm* — Resolute Legal PLLC

(57) ABSTRACT

A flush mount register comprising a damper box; a substrate tray secured and nested within the damper box; and having a gap defined between the substrate tray and the damper box; and wherein the substrate tray receives a flooring substrate.

15 Claims, 5 Drawing Sheets

(56) References Cited

U.S. PATENT DOCUMENTS

| | | | | |
|---|---|---|---|---|
| 2006/0079171 | A1* | 4/2006 | Lu | F24F 13/1426 454/325 |
| 2011/0034120 | A1* | 2/2011 | Jaiyeola | G05D 23/1934 700/282 |
| 2013/0072104 | A1* | 3/2013 | Picco | F24F 13/085 454/289 |
| 2016/0290661 | A1* | 10/2016 | Ogura | F24F 13/08 |
| 2019/0128558 | A1* | 5/2019 | Mantenuto | F24F 13/06 |
| 2019/0137138 | A1* | 5/2019 | Uddin Syed | F24F 13/1413 |

* cited by examiner

DROP IN FLUSH MOUNT REGISTER

CROSS REFERENCE TO RELATED APPLICATIONS

This application is a continuation-in-part of U.S. patent application Ser. No. 16/290,499, filed Mar. 1, 2019, which claims priority to U.S. Provisional Application Ser. No. 62/637,694 filed on Mar. 2, 2018, whose entire disclosures are hereby incorporated by reference.

FIELD

The present disclosure relates to ventilation heating and cooling systems, and more particularly it relates to flush mount air registers.

BACKGROUND

In forced air heating and cooling systems a fan associated with a furnace forces air through a duct system to distribute heated air or conditioned air throughout a building. Air emerges from outlets in the duct system, and the outlets generally include registers operable to regulate the flow of air. For registers which are situated in a floor, a grill is typically placed over the vent opening to provide an aesthetically pleasing appearance to the outlet. Normally, when installing flooring it is often desirable to include a register grill that also matches the flooring in order to give the flooring a homogeneous look. However, most flooring manufacturers and home improvement stores only have limited types and styles of register grills available, and end users are often forced to find the closest match to the flooring, and make do with their choice. Even if one was to consider custom manufacturing a limited number of register grills for a particular flooring, such a process may be impractical, expensive, and time consuming, as most manufacturers require minimum volumes to justify the cost of specialized tooling and dedicated personnel. In addition, given that there may be variations in flooring from batch to batch due to the nature of wood or tile, such matching may be difficult to achieve leading to inconsistencies in the overall flooring appearance.

SUMMARY OF THE INVENTION

In one of its aspects, there is provided a flush mount register comprising:

a damper box;

a substrate tray secured and nested within the damper box; and having a gap defined between the substrate tray and the damper box; and wherein the substrate tray receives a flooring substrate.

In another of its aspects, there is provided a flush mount register for installation on a surface, the flush mount register comprising:

a damper box;

a substrate tray secured and nested within the damper box; and having a gap defined between the substrate tray and the damper box; and wherein the substrate tray receives a substrate such that the substrate is flush with the surface.

Advantageously, the system comprises a damper box and substrate tray, which are both flush with the flooring, and can be used for flooring with various thicknesses e.g. 0.375 inches to 0.75 inches.

In addition, the system can be customized for installation in flooring with various floor thicknesses, by simply adjusting the height of the flooring substrate frame such that flooring substrate frame, and tray with flooring substrate are flush with the rest of the flooring. Accordingly, there is no need multiple stock keeping units (SKUs) for each floor thickness or vent opening.

Furthermore, the system allows any flooring system to be matched regardless of the flooring material. For example, the flooring material may be wood, laminate, carpet, engineered products, tile, carpet and vinyl.

DETAILED DESCRIPTION OF EXEMPLARY EMBODIMENTS

The detailed description of exemplary embodiments of the invention herein makes reference to the accompanying block diagrams and schematic diagrams, which show the exemplary embodiment by way of illustration and its best mode. While these exemplary embodiments are described in sufficient detail to enable those skilled in the art to practice the invention, it should be understood that other embodiments may be realized and that logical and mechanical changes may be made. Thus, the detailed description herein is presented for purposes of illustration only and not of limitation. For example, the steps recited in any of the method or process descriptions may be executed in any order and are not limited to the order presented.

Moreover, it should be appreciated that the particular implementations shown and described herein are illustrative of the invention and its best mode and are not intended to otherwise limit the scope of the present invention in any way. Indeed, for the sake of brevity, certain sub-components of the individual operating components.

Figure 1A:
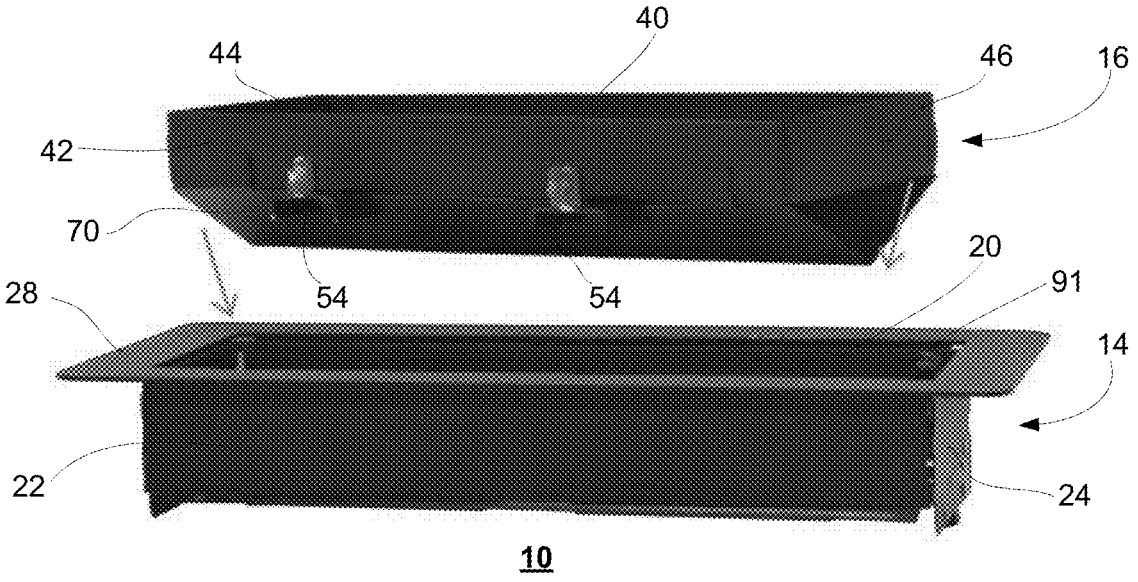
FIG. 1*a* shows a view of a flush mount register system.
Figure 1B:
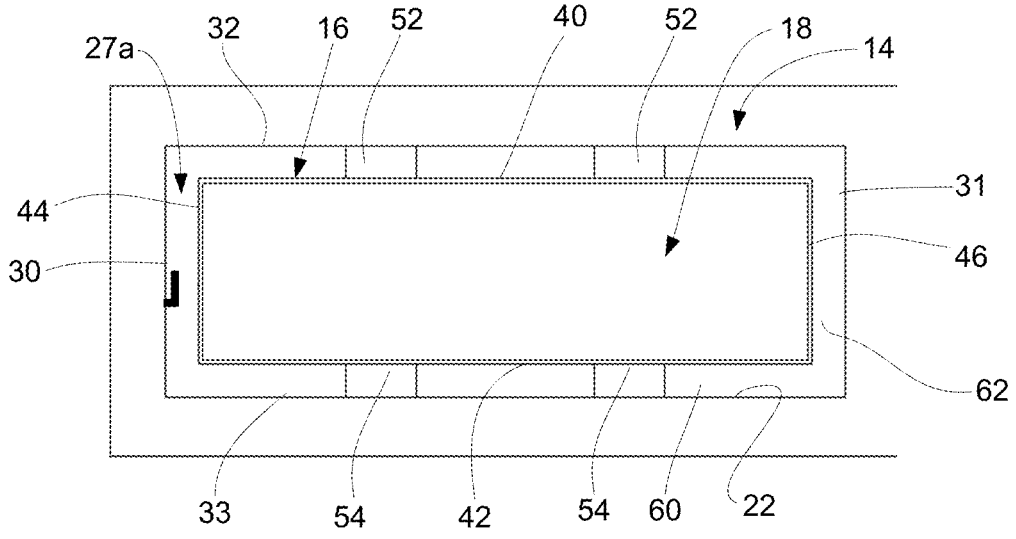
FIG. 1*b* shows a top view of the flush mount register system.
Figure 1C:
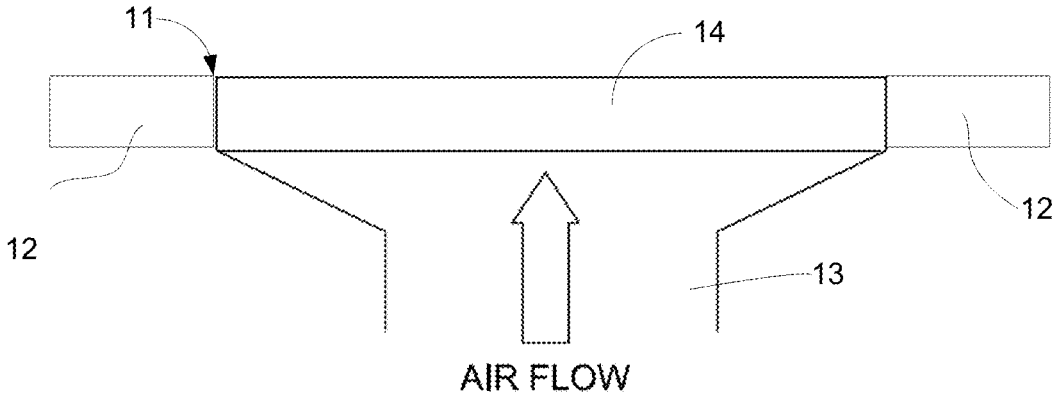
FIG. 1*c* shows a sectional view of the flush mount register system installed in a floor.

Looking at FIGS. 1*a* and 1*b* there is shown flush mount register system 10 for installation in an opening 11 of surface 12, such as a floor covered by flooring. Opening 11 is in fluid communication with duct 13 coupled to a HVAC system (not shown). Generally, flush mount register 10 comprises damper box 14 resting on flooring 12. Nested within damper box is substrate tray 16 which receives flooring substrate 18. Accordingly, having flooring substrate 18 that is identical to flooring 12 leads to a more desirable aesthetic look.

Figure 2:
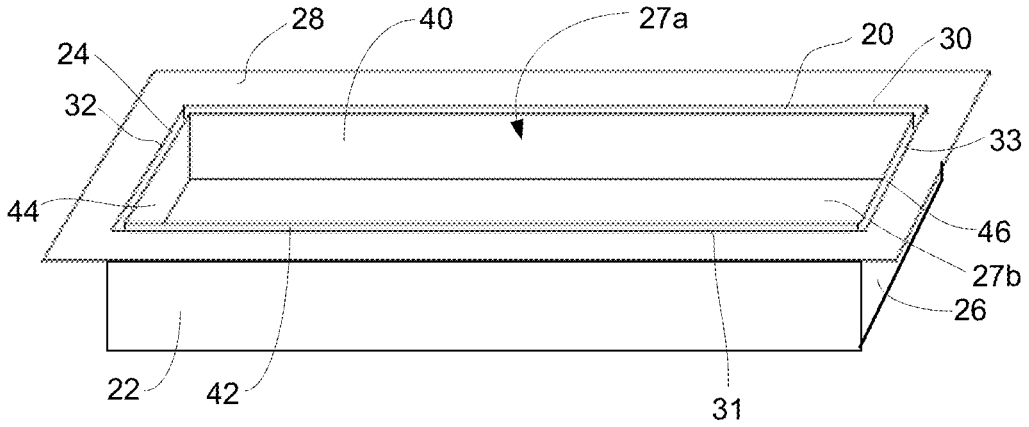
FIG. 2 shows a perspective view of the flush mount register system.

Now referring to FIG. 2, damper box 14 comprises first pair of longitudinally extending side walls 20, 22 and first pair of laterally extending sidewalls 24, 26, which are joined to form a rectangular shape with top opening 27*a* and bottom opening 27*b*. Longitudinally extending walls 20, 22 and laterally extending sidewalls 24, 26 comprise rectangular flange 28 extending outwardly and orthogonally from top edges 30, 31 of longitudinally extending walls 20, 22, and extending outwardly and orthogonally from top edges 32, 33 of first pair of laterally extending sidewalls 24, 26. Bottom edges 34, 35 of first pair of longitudinally extending side walls 20, 22 and bottom edges 36, 37 of first pair of laterally extending sidewalls 24, 26, define bottom opening 27*b*. Substrate tray 16 is located within top opening 27 and extends to bottom opening 27*b*.

Figure 3A:
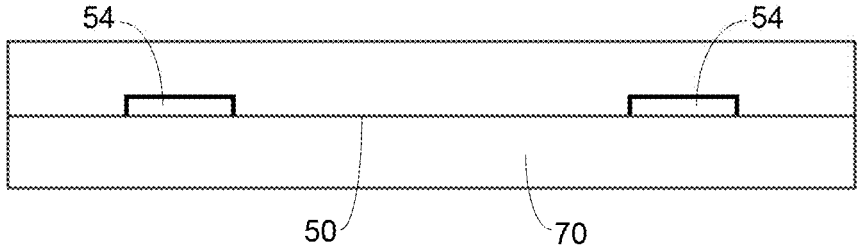
FIG. 3*a* shows a lateral side view of a substrate tray.
Figure 3B:
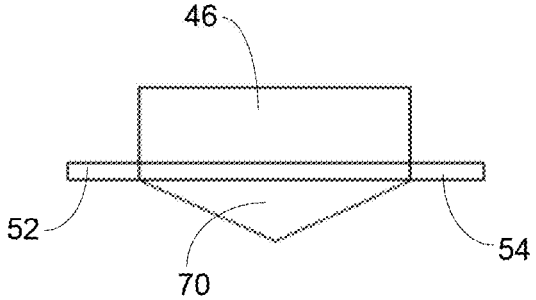
FIG. 3*b* shows a longitudinal side view of the substrate tray.
Figure 3C:
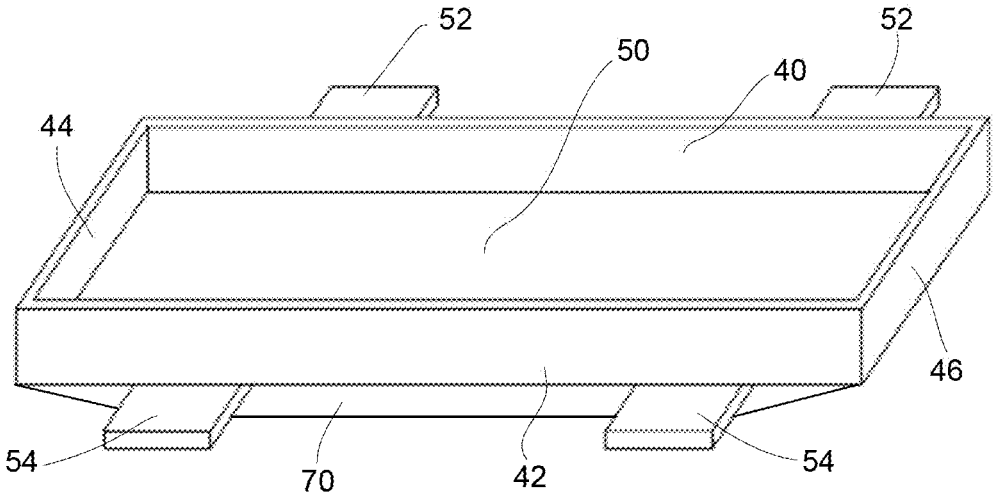
FIG. 3*c* shows a perspective top view of the substrate tray.

FIGS. 3*a* to 3*c* show different views of substrate tray 16 in more detail. As can be seen, substrate tray 16 comprises second longitudinally extending walls 40, 42 and laterally extending walls 44, 46, joined together to form a rectangular shape, with top opening 48 and base 50. Bottom edges of second longitudinally extending walls 40, 42 comprise struts 52, 54, respectively, extending outwardly and perpendicularly away from second longitudinally extending walls 40, 42. Struts 52, 54, may be secured, joined, or welded to first pair of longitudinally extending side walls 20, 22, such that gap 60 is defined between first pair of longitudinally extending side walls 20, 22 of damper box 14 and second longitudinally extending walls 40, 42 of substrate tray 16; and gap 62 is defined between first pair of laterally extending sidewalls 24, 26 of damper box 14 and second pair of laterally extending walls 44, 46 substrate tray 16, respectively. Air from duct 13 is forced through gaps 60 and 62 into the space.

Now looking at FIG. 3*b*, base 50 of substrate tray 16 comprises air deflector 70 for directing air towards gap 60 defined between first pair of longitudinally extending side walls 20, 22 and second longitudinally extending walls 40, 42, thereby increasing air flow through gap 60. In another implementation, air deflector 70 may be configured to directing air towards gap 62 defined between first pair of laterally extending sidewalls 24, 26 and second pair of laterally extending walls 44, 46, thereby increasing air flow through gap 62. In yet another implementation, air deflector 70 may be configured to directing air towards gaps 60 and/or 62.

Flooring substrate 18 is dimensioned to fit within substrate tray 16, such that substrate tray 16 is flush with flooring 12. The depth of substrate tray 16 may be adjusted, or may be varied to allow for full customization of flush mount register system 10 to match the various thicknesses of flooring 12. Accordingly, flush mount register system 10 can be easily installed, without having to level any other component of flush mount register system 10.

Figure 4A:
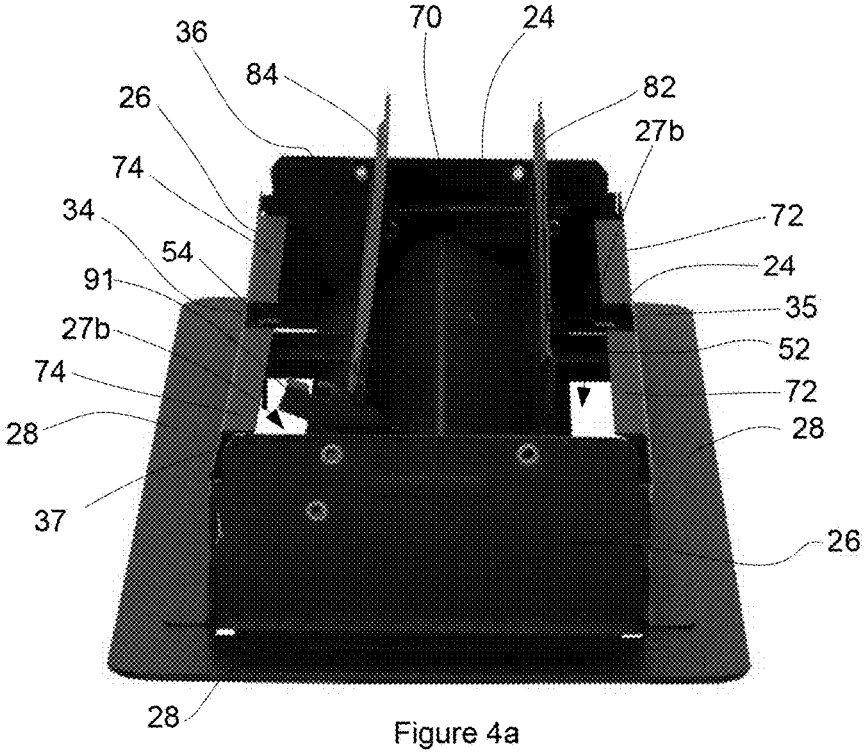
FIG. 4*a* shows a side perspective bottom view of the flush mount register system.
Figure 4B:
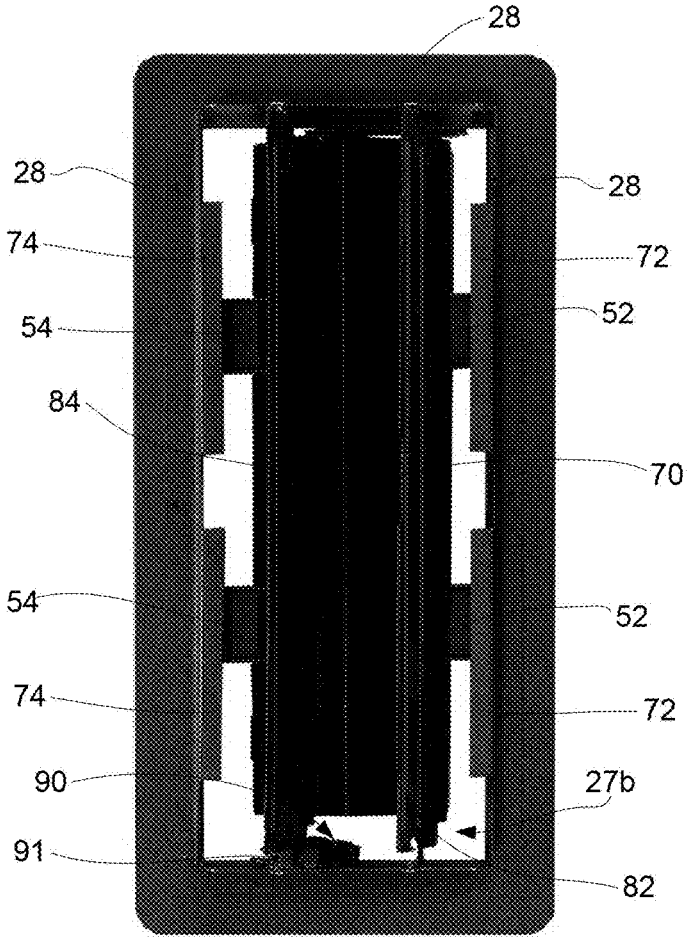
FIG. 4*b* shows a bottom view of the flush mount register system.
Figure 4C:
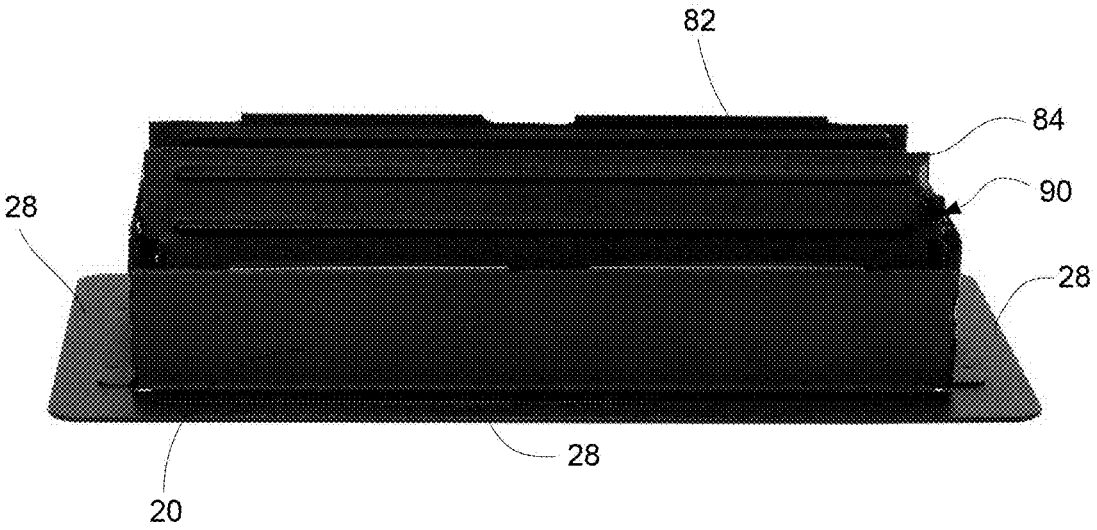
FIG. 4*c* shows a bottom perspective view of the flush mount register system.

Referring now to FIG. 4*a*, there is shown a perspective bottom view of register 10, and FIG. 4*b* shows a top view of register 10. Damper box 14 comprises flanges 72 extending from bottom edge 34 and flanges 74 extending from bottom edge 35, and damper mechanism 80 comprising dampers 82, 84 operable to substantially open and close bottom opening 27*b*. Accordingly, damper box mechanism 80 is operable between a closed state, partially open state, and an open state. Dampers 82, 84 are generally rectangular-shaped and comprise opposed longitudinal edges and opposed lateral edges and are caused to rotate about first pair of laterally extending sidewalls 24, 26 by an actuating mechanism 90. Actuating mechanism 90 comprises interconnection mechanism interconnecting dampers 82, 84 to cause dampers 82, 84 to rotate in synchrony, thereby opening and closing bottom opening 28, to regulate air flow from duct 13. For example, actuating mechanism further comprises lever mechanism 91 that is operable to place dampers 82, 84 between various degrees of open states or closed states. Lever mechanism 91 extends between gap 62 defined between first pair of laterally extending sidewalls 24, 26 and second pair of laterally extending walls 44, 46. edges 34, 35 In another implementation, the length of lever mechanism may be dimensioned to suit the thickness of flooring 12. FIG. 4*b* shows a bottom plan view of register system 10. FIG. 4*c* shows a bottom plan view of register system 10.

In a closed state of damper box 14, dampers 82, 84 are substantially perpendicular to laterally extending walls 54, 56, respectively. As such, dampers 82, 84 overlap each other, such that a portion of longitudinal edge of damper 82 rests on topside of bottom flanges 72 and a portion of longitudinal edge of damper 84 abuts underside of bottom flanges 74, and a portion of longitudinal edge of damper 84 overlaps longitudinal edge of damper 82, or vice-versa.

In a partially open state or partially closed state of damper box 14, opposed longitudinal edges of dampers 82, 84 are angled towards first pair of longitudinally extending walls 20, 22, respectively.

In a fully open state of damper box 14, dampers 82, 84 are substantially parallel to longitudinally extending walls 20, 22, respectively. In a fully closed state of damper box 14, dampers 82, 84 are substantially orthogonal to longitudinally extending walls 20, 22, respectively.

In addition, damper box 14 and substrate tray 16 are dimensioned to fit inside industry standard vent openings 11. Accordingly, when flush mount register system 10 is fully assembled, substrate tray 16 is capable of supporting similar forces imposed on flooring 12, such as those from furniture, objects or people.

In another implementation, damper box 14 includes a single damper or any number of dampers, depending on the size of the opening 11, application, desired results, and user preferences.

In another implementation, while the system 10 is primarily meant to be installed at the same time as the flooring material 18, it can be modified to allow use of leftover flooring such that the finished product matches the existing flooring material 18.

In another implementation, substrate tray 16 is removably secured to damper box 14.

Those skilled in the art will recognized that the dimensions shown in the drawings are exemplary in nature only, as these dimensions are applicable in one exemplary implementation e.g. for 4"×10" vent openings, and therefore can vary depending on the requirements for a particular application, desired results, and user preferences. For example, flush mount register system 10 may be dimensioned to fit any opening, accordingly exemplary sizes of flush mount register system 10 may be 2"×12" and 4"×12".

In another implementation, the system 10 is installed in a ceiling or a wall. Accordingly, substrate tray 16 may house ceiling tile or drywall.

In another implementation, each of the pair of second laterally extending walls 44, 46 of substrate tray 16 comprise at least one strut extending outwardly, wherein one end of the struts 52, 54 is secured to the first pair of laterally extending side walls 24, 26 of damper box 14.

The preceding detailed description of exemplary embodiments of the invention makes reference to the accompanying drawings, which show the exemplary embodiment by way of illustration. While these exemplary embodiments are described in sufficient detail to enable those skilled in the art to practice the invention, it should be understood that other embodiments may be realized and that logical and mechanical changes may be made. For example, the steps recited in any of the method or process claims may be executed in any order and are not limited to the order presented. Further, the present invention may be practiced using one or more servers, as necessary. Thus, the preceding detailed description is presented for purposes of illustration only and not of limitation, and the scope of the invention is defined by the preceding description, and with respect to the attached claims.

The invention claimed is:

1. A flush mount register comprising:

a damper box;

a substrate tray secured and nested within the damper box; and having a continuous peripheral gap defined between the substrate tray and the damper box;

wherein the substrate tray receives a substrate;

wherein the damper box comprises a first pair of longitudinally extending side walls and a first pair of laterally extending sidewalls which are joined to form a rectangular shape with a damper top opening and a damper bottom opening;

wherein the substrate tray comprises a second pair of longitudinally extending side walls and a second pair of laterally extending sidewalls which are joined to form a rectangular shape with a base and a substrate tray opening; and wherein each of the second pair of longitudinally extending side walls comprise at least one strut extending outwardly, wherein one end of the at least one strut is secured to the first pair of longitudinally extending side walls.

2. The flush mount register of claim 1, wherein the substrate is contained within the second pair of longitudinally extending side walls and the second pair of laterally extending sidewalls.

3. The flush mount register of claim 2, wherein the damper box comprises at least one damper and an actuating mechanism to place the damper bottom opening between a closed state, partially open state, and an open state.

4. The flush mount register of claim 3, wherein the actuating mechanism comprises a lever mechanism and interconnection mechanism between the at least one damper.

5. The flush mount register of claim 1, wherein the substrate tray is removably secured to the damper box.

6. The flush mount register of claim 1, wherein the base of the substrate tray comprises an air deflector for directing air towards the continuous peripheral gap, thereby increasing air flow through the continuous peripheral gap.

7. The flush mount register of claim 6, wherein the damper box and the substrate tray are coplanar, such that the flooring substrate is flush with a surrounding flooring.

8. A flush mount register for installation on a surface, the flush mount register comprising:

a damper box;

a substrate tray secured and nested within the damper box; and having a continuous peripheral gap defined between the substrate tray and the damper box;

wherein the substrate tray receives a substrate such that the substrate is flush with the surface;

wherein the damper box comprises a first pair of longitudinally extending side walls and a first pair of laterally extending sidewalls which are joined to form a rectangular shape with a damper top opening and a damper bottom opening;

wherein the substrate tray comprises a second pair of longitudinally extending side walls and a second pair of laterally extending side walls which are joined to form a rectangular shape with a base and a substrate tray opening for receiving the substrate; and wherein each of the second pair of longitudinally extending side walls comprise at least one strut extending outwardly, wherein one end of the at least one strut is secured to the first pair of longitudinally extending side walls.

9. The flush mount register of claim 8, wherein each of the first pair of longitudinally extending side walls comprises at least one flange.

10. The flush mount register of claim 9, wherein the damper box comprises at least one damper and an actuating mechanism to place the damper bottom opening between a closed state, partially open state, and an open state.

11. The flush mount register of claim 10, wherein, in the closed state a portion of each of the at least one damper rests on the least one flange.

12. The flush mount register of claim 10, wherein the actuating mechanism comprises a lever mechanism and interconnection mechanism between the at least one damper.

13. The flush mount register of claim 8, wherein the base of the substrate tray comprises an air deflector for directing air towards the continuous peripheral gap.

14. The flush mount register of claim 8, wherein the surface comprises at least one of a flooring, a wall and a ceiling.

15. The flush mount register of claim 14, wherein the substrate is identical to the surface.

* * * * *